US007603746B1

(12) United States Patent
von Resch et al.

(10) Patent No.: US 7,603,746 B1
(45) Date of Patent: Oct. 20, 2009

(54) ADJUSTABLE BUTT HINGES FOR DOORS

(75) Inventors: Julius von Resch, Stuttgart (DE); Jan M. Huml, Medford, WI (US)

(73) Assignee: G-U Hardware, Inc., Newport News, VA (US)

( * ) Notice: Subject to any disclaimer, the term of this patent is extended or adjusted under 35 U.S.C. 154(b) by 1354 days.

(21) Appl. No.: 10/247,326

(22) Filed: Sep. 20, 2002

(51) Int. Cl.
*E05D 7/04* (2006.01)

(52) U.S. Cl. ..... 16/245; 16/238; 16/248; 16/260; 16/265

(58) Field of Classification Search ..... 16/238, 16/242–248, 260–262, 264–265, 236, 263
See application file for complete search history.

(56) References Cited

U.S. PATENT DOCUMENTS

| | | | | | |
|---|---|---|---|---|---|
| 279,857 | A | * | 6/1883 | Campbell | 16/245 |
| 730,265 | A | | 6/1903 | Hill | |
| 994,196 | A | | 6/1911 | Reddick | |
| 1,094,136 | A | * | 4/1914 | Donohue | 16/242 |
| 1,208,422 | A | | 12/1916 | Way | |
| 1,307,807 | A | | 6/1919 | Carlisle | |
| 1,540,581 | A | | 6/1925 | Way | |
| 1,563,869 | A | * | 12/1925 | Larson | 16/243 |
| 1,782,490 | A | | 11/1930 | Torgerson | |
| 2,096,311 | A | * | 10/1937 | Strough | 16/245 |
| 2,255,529 | A | | 9/1941 | May | |
| 2,532,772 | A | * | 12/1950 | Kamfjord | 16/248 |
| 2,533,502 | A | | 12/1950 | Philips | |
| 3,210,798 | A | * | 10/1965 | Tice | 16/245 |
| 3,596,307 | A | | 8/1971 | Kolmetsky | |
| 3,940,829 | A | | 3/1976 | Grunert et al. | |
| 4,159,557 | A | | 7/1979 | Pittasch et al. | |
| 4,185,357 | A | | 1/1980 | Busse | |
| 4,381,580 | A | | 5/1983 | Hellstrom et al. | |
| 4,493,129 | A | | 1/1985 | Grass | |
| 4,494,275 | A | * | 1/1985 | Hsi-Shan | 16/314 |
| 4,785,498 | A | | 11/1988 | Brotschi | |
| 4,817,241 | A | | 4/1989 | Koch et al. | |
| 4,825,507 | A | | 5/1989 | Killingstad | |

(Continued)

FOREIGN PATENT DOCUMENTS

| | | |
|---|---|---|
| AT | 189536 | 4/1957 |

(Continued)

*Primary Examiner*—Peter M Cuomo
*Assistant Examiner*—Christopher Boswell
(74) *Attorney, Agent, or Firm*—James Creighton Wray; Meera P. Narasimhan

(57) ABSTRACT

A three-way adjustable butt hinge for a door is adjusted vertically in a door frame by inserting an allen wrench in a vertical adjustment screw at the top of the hinge pin. Turning the wrench moves the screw in either direction, pushes on the hinge pin and raises or lowers the door as necessary. A pin has an eccentric shaft with upper and lower sections offset on parallel axes. Lateral adjustments are effected by loosening a side-mounted set screw and turning the eccentric shaft as necessary to move the door either in or out or side to side in the frame. The lateral set screw holds the hinge pin integral with the sash hinge. The door is removed from the frame by simply lifting the door sash hinge and pin from the complementary pin receiver on the frame hinge.

12 Claims, 2 Drawing Sheets

U.S. PATENT DOCUMENTS

| | | | | | |
|---|---|---|---|---|---|
| 4,827,568 | A | * | 5/1989 | Ramsauer | 16/266 |
| 5,058,236 | A | | 10/1991 | Henson | |
| 5,172,452 | A | * | 12/1992 | Brown | 16/387 |
| 5,339,493 | A | | 8/1994 | MacIntyre | |
| 5,481,783 | A | * | 1/1996 | Liou | 16/264 |
| 5,669,105 | A | * | 9/1997 | Depke | 16/245 |
| 5,799,370 | A | | 9/1998 | Davidian et al. | |
| 5,930,867 | A | * | 8/1999 | Grzeskowiak | 16/244 |
| 6,202,255 | B1 | * | 3/2001 | Sitter | 16/242 |
| 6,212,734 | B1 | | 4/2001 | Commons | |
| 6,276,025 | B1 | * | 8/2001 | Leibman | 16/241 |
| 6,397,432 | B1 | | 6/2002 | di Vinadio | |
| 6,725,504 | B1 | * | 4/2004 | Dickson et al. | 16/236 |

FOREIGN PATENT DOCUMENTS

| | | | | |
|---|---|---|---|---|
| AT | 401665 | | | 11/1987 |
| DE | 3739810 | | | 2/1989 |
| DE | 10236031 | C1 | * | 7/2003 |
| FR | 2618836 | | | 2/1989 |
| GB | 2032994 | | | 5/1980 |
| GB | 2207456 | | | 2/1989 |
| GB | 2259946 | A | * | 3/1993 |

* cited by examiner

ADJUSTABLE BUTT HINGES FOR DOORS

BACKGROUND OF THE INVENTION

Door hinges, which are also called sash hinges, require pulling pins, usually in three separate steps, to remove doors from frames. Pulling pins is difficult and requires tools. Sometimes difficulty is increased by accumulation of paint on hinges and pins.

Setting doors and frames is a skilled task. Often doors come preassembled with frames. After frame installation, slight adjustment may be required to make doors hang properly. Adjustments are difficult because hinge plates are preset in recesses in the frames and doors, and because slightly offsetting screws is difficult. Lateral adjustments are difficult to make the door center precisely in the secured frame. Vertical adjustments are necessary to accommodate floors, floor coverings and flooring thicknesses.

Needs exist for improved door hinges.

SUMMARY OF THE INVENTION

A three-way adjustable butt hinge for a door can be adjusted vertically by inserting an allen wrench in an adjustment screw at the top of the hinge pin. Turning the wrench raises or lowers the door as necessary. Lateral adjustments are effected by loosening a side-mounted allen set screw and turning the eccentric shaft as necessary to move the door either in or out or side to side. Since the hinge pin is integral with the sash hinge, the door can be removed from the frame by simply lifting the door.

A preferred adjustable butt hinge apparatus mounts a door in a door frame. A door frame hinge plate has an upwardly opening cylindrical pin-receiving knuckle attached to and extending from a lower part of one side edge of the door frame hinge plate. The pin-receiving knuckle has an obstructed lower end and a cylindrical bore. A door hinge plate attaches to an edge of a door. A cylindrical downward opening pin-holding knuckle attaches to and extends from a side edge of the door hinge plate. The downward opening pin-holding knuckle has a downward opening cavity with an upper closed end. A tapped hole extends vertically through the upper closed end. A vertical adjusting screw has proximal and distal ends and threads mated in the tapped hole for adjustably extending the distal end of the vertical adjusting screw in directions into and out of the cavity by turning the proximal end. An eccentric pin has offset cylindrical upper and lower sections with respective upper and lower ends. The upper section is inserted in the downward opening cavity of the pin-holding knuckle. The upper end of the eccentric pin contacts the distal end of the vertical adjusting screw for raising and lowering the door with respect to the frame. A tapped hole extends laterally through a wall of the pin-holding knuckle. A lateral screw is threaded in the tapped hole for engaging the upper section of the eccentric pin and preventing turning of the upper section in the pin-holding knuckle. Loosening the lateral screw and turning the pin in the pin-holding knuckle adjusts the door hinge plate side to side and in and out with respect to the door frame hinge plate before retightening the lateral screw.

A plastic bushing is positioned in the cylindrical bore of the upward opening pin-receiving knuckle for surrounding the lower section of the pin. A plastic cup positioned in the cylindrical bore may replace the bushing in the pin-receiving knuckle for surrounding the lower section of the pin.

The adjustable butt hinge apparatus mounts a door in a door frame. The new hinge has first and second mounting plates for attaching respectively to a frame and to a door. First and second generally axially aligned knuckles have inwardly opening cylindrical receivers attached to and extending from edges of the first and second plates The receivers have first and second cylindrical cavities with closed ends and open ends. The open ends are positioned near each other and in general alignment with each other, and the closed ends of the cavities are positioned remote from each other. An eccentric pin is mounted in the cavities. The eccentric pin has first and second cylindrical portions offset on parallel axes and respectively mounted in the first and second cavities. A lateral tapped opening in the first receiver extends from an outside thereof into the first cavity. A lateral set screw extends through the lateral tapped opening for releasing and fixing the first cylindrical section of the eccentric pin in the first cavity for relatively adjusting the first and second mounting plates by moving the plates in and out and side to side after loosening the lateral set screw and releasing the eccentric pin. Tightening the lateral set screw fixes the first cylindrical section of the eccentric pin in the first cavity.

A preferred method of adjusting a door with respect to a door frame separately connects a cylindrical pin receiver and a complementary cylindrical pin holder to a door frame and to a door. A lateral set screw is loosened in one cylindrical pin holder. An eccentric pin, which has offset upper and lower cylindrical sections, is twisted in the cylindrical pin holder and in a cylindrical pin receiver. The twisting of the pin is effected by the adjusting of the door in and out or side to side with respect to the frame. The door is repositioned in and out or side to side with respect to a frame. The lateral set screw is tightened on the pin, thereby adjusting the door in and out and side to side with respect to the door frame.

A vertical screw is turned at an end of one of the cylindrical pin holders in a direction inward or outward in the cylindrical pin holder for moving an end of the pin with an end of the vertical screw and raising or lowering the door.

The door is removed from the frame simply by lifting the door.

Preferably lifting the door also lifts the cylindrical pin holder and the pin from the upward opening cylindrical pin receiver.

The three-way adjustable butt hinge for doors does not require special milling. The new hinges make installing a door easier. Turning a screw with an allen wrench on the top of the hinge easily raises or lowers a door to ensure proper sealing and proper operation. Side to side adjustment simply loosens the side mounted allen screw and turns the eccentric shaft to adjust the door from side to side and in and out. Furthermore, doors can be easily removed from the frame for times when large objects need to pass in and out of the door. There are no more pins to remove. One simply opens the door and lifts the door with the sash plates and attached hinge pins, thereby lifting the door, sash plates and hinge pins fixed therein from the frame plate knuckles.

The new hinges provide three-way adjustability. The hinges are able to support sash weights up to about 300 lbs and incorporate a standard ⅝" radius on corners. The new hinges are perfect for both inswing and outswing doors. It is easy to separate the sash from the frame. Locking set screws provide added security.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
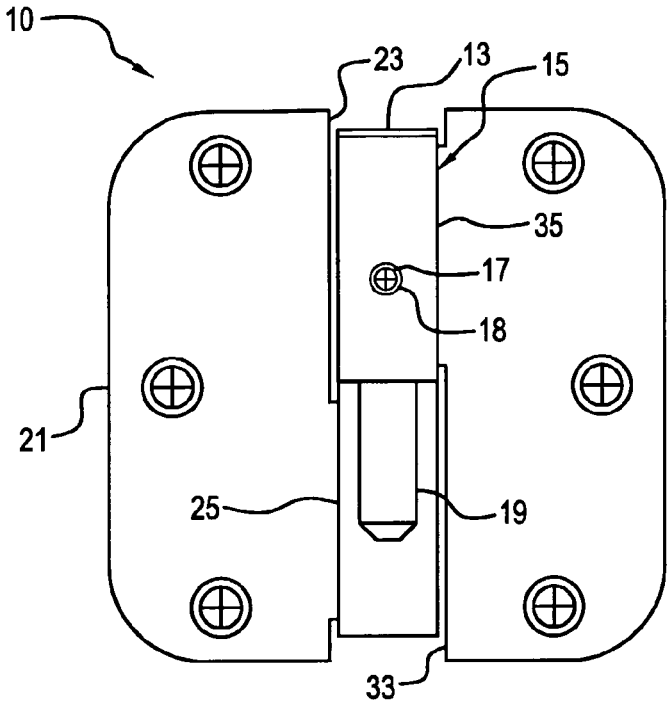
FIG. 1 is an elevation of the adjustable butt hinge.

Referring to the drawings, a three-way adjustable butt hinge 10 for a door can be adjusted vertically by inserting an allen wrench in an adjustment screw 11 (FIG. 4) at the top 13 of the hinge pin holder 15. Turning the wrench raises or lowers the door as necessary. Lateral adjustments are effected by loosening a side-mounted allen set screw 17 and turning the eccentric pin 19 as necessary to move the door either in or out or side to side. Since the hinge pin 19 is integral with the sash hinge plate, the door can be removed from the frame by simply lifting the door.

Figure 4:
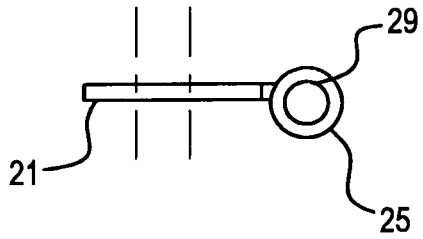
FIG. 4 is a top plan view of the frame mounting plate.
Figure 5:
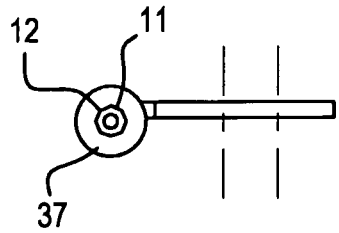
FIG. 5 is a top plan view of the door mounting plate.
Figure 6:
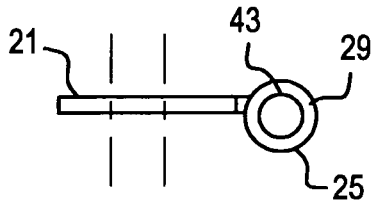
FIG. 6 is a bottom view of the frame mounting plate.

As shown in FIGS. 1-8, a preferred adjustable butt hinge apparatus 10 mounts a door in a door frame. A door frame hinge plate 21 has an upwardly opening cylindrical pin-receiving knuckle 25 attached to and extending from a lower part of one side edge 23 of the door frame hinge plate. The pin-receiving knuckle 25 has an obstructed lower end 27 and a cylindrical bore 29 (FIGS. 4, 6). A door hinge plate 31 attaches to an edge of a door. A cylindrical downward opening pin-holding knuckle 35 attaches to and extends from a side edge 33 of the door hinge plate 31. The downward opening pin-holding knuckle 35 has a downward opening cavity 39 with an upper closed end 37.

A tapped hole 12 (FIG. 5) extends vertically through the upper closed end 37. A vertical adjusting screw 11 (FIGS. 5, 8) has proximal and distal ends and threads mated in the tapped hole for adjustably extending the distal end of the vertical adjusting screw in directions into and out of the end of the cavity 39 by turning the proximal end.

An eccentric pin 19 has offset cylindrical upper and lower sections with respective upper and lower ends. The upper section is inserted in the downward opening cavity 39 of the pin-holding knuckle 35. The upper end of the eccentric pin contacts the distal end of the vertical adjusting screw 11 for raising and lowering the door with respect to the frame. A tapped hole 18 extends laterally through a cylindrical wall of the pin-holding knuckle 35. A lateral screw 17 is threaded in the tapped hole 18 for engaging the upper section of the eccentric pin and preventing turning of the upper section in the pin-holding knuckle 35. Loosening the lateral screw 17 and turning the pin in the pin-holding knuckle 35 adjusts the door hinge plate side to side and in and out with respect to the door frame hinge plate before retightening the lateral screw 17.

Figure 2:
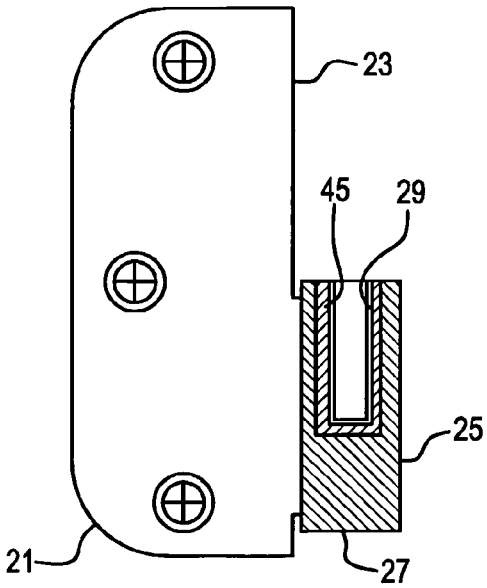
FIG. 2 is an elevation of the frame mounting plate
Figure 3:
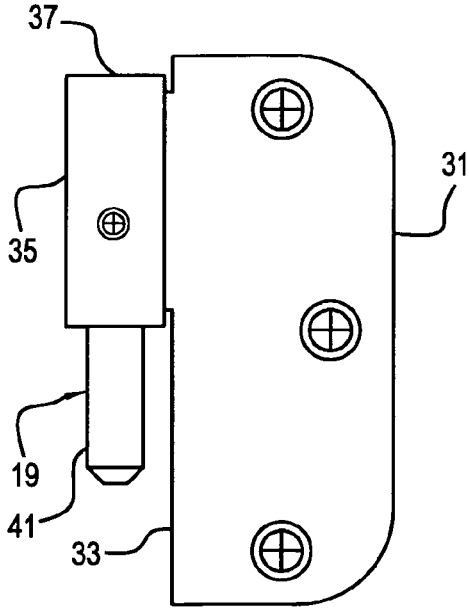
FIG. 3 is an elevation of the door mounting plate.
Figure 7:
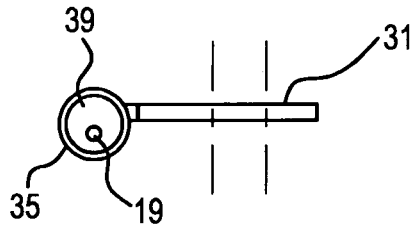
FIG. 7 is a bottom view of the door mounting plate.
Figure 8:
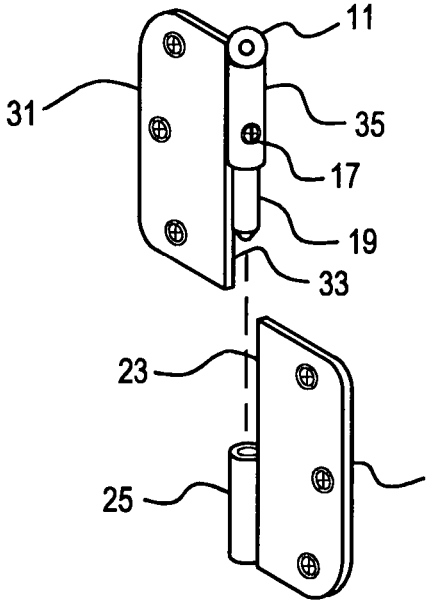
FIG. 8 is an exploded view of the new hinge.

As shown in FIGS. 6 and 7, a plastic bushing 43 is positioned in the cylindrical bore 29 of the upward opening pin-receiving knuckle 25 for surrounding the lower section 41 of the pin 19. As shown in FIG. 2, a plastic cup 45 positioned in the cylindrical bore 29 may replace the bushing 43 in the pin-receiving knuckle 25 for surrounding the lower section 41 of the pin 19.

A preferred method of adjusting a door with respect to a door frame separately connects a cylindrical pin receiver 25 and a complementary cylindrical pin holder 35, respectively, to a door frame and to a door. A lateral set screw 17 is loosened in the cylindrical pin holder 35. An eccentric pin 19, which has offset upper and lower cylindrical sections, is twisted in the cylindrical pin holder 35 and in a cylindrical pin receiver 25. The twisting of the pin is effected by the adjusting of the door in and out or side to side with respect to the frame. The door is repositioned in and out or side to side with respect to a frame. The lateral set screw 17 is tightened on the pin, thereby adjusting the door in and out and side to side with respect to the door frame.

Before the lateral adjusting, the door is adjusted vertically. A vertical screw 11 is turned at an end of the cylindrical pin holder 35 in a direction inward or outward in the cylindrical pin holder for moving an end of the pin with an end of the vertical screw and raising or lowering the door.

The door is removed from the frame simply by lifting the door, the attached door hinge plate 31 and pin 19 from the pin receiver 25 on the frame hinge plate 21.

Preferably lifting the door also lifts the cylindrical pin holder 35 and the pin 19 from the upward opening cylindrical pin receiver 25.

The three-way adjustable butt hinge 10 for doors does not require special milling. The new hinges make installing a door easier. Turning a screw 11 with an allen wrench on the top of the hinge easily raises or lowers a door to ensure proper height, sealing and operation. Side to side adjustment simply loosens the side mounted allen screw 17 and turns the eccentric shaft 19 to adjust the door from side to side and in and out. Furthermore, doors can be easily removed from the frame for times when large objects need to pass in and out of the door. There are no more pins to remove. One simply opens the door and lifts the door with the sash 31 plates and attached hinge pins 19, thereby lifting the door, sash plates and hinge pins fixed therein from the frame plate knuckles 25.

The new hinges provide three-way adjustability. The hinges are able to support sash weights up to about 300 lbs and incorporate a standard ⅝" radius on corners. The new hinges are perfect for both in swinging and out swinging doors. It is easy to separate the sash from the frame. Locking set screws provide added security.

In preferred embodiments, pins are about 10 mm in diameter and are about 50 mm long, and are set on centers about 44.5 mm from outer edges of the hinge plates. The hinges provide adjustment of +4 mm in height and ±1 mm in lateral directions.

While the invention has been described with reference to specific embodiments, modifications and variations of the invention may be constructed without departing from the scope of the invention, which is defined in the following claims.

I claim:

1. An adjustable butt hinge apparatus for mounting a door in a door frame, comprising a door frame hinge plate, an upward opening cylindrical pin-receiving knuckle attached to and extending from a lower part of one side edge of the door frame hinge plate, the pin-receiving knuckle having an obstructed lower end, the pin-receiving knuckle having a cylindrical bore, a door hinge plate for attaching to an edge of a door, a cylindrical downward opening pin-holding knuckle attached to and extending from a side edge of the door hinge plate, the downward opening pin-holding knuckle having a downward opening cavity with an upper closed end, a threaded hole extending vertically through the upper closed end and a vertical adjusting screw having proximal and distal ends and threads mated in the threaded hole for adjustably extending the distal end of the vertical adjusting screw in directions into and out of the cavity by turning the proximal end, an eccentric pin having offset cylindrical upper and lower sections offset on parallel axes, with respective upper and lower ends, the upper section being inserted in the downward opening cavity of the pin-holding knuckle, with the upper end of the eccentric pin contacting the distal end of the vertical adjusting screw for raising and lowering the door frame hinge plate with respect to the upper section of the pin, and raising and lowering the door with respect to the frame, a tapped hole extending laterally through a wall of the pin-holding knuckle, and a lateral screw threaded in the tapped hole for engaging the upper section of the eccentric pin and preventing turning of the upper section in the pin-holding knuckle, for loosening the lateral screw and turning the pin in the pin-holding knuckle and adjusting the door hinge plate side to side and in and out with respect to the door frame hinge plate, and thereby adjusting the door with respect to the frame before retightening the lateral screw and fixing the door in adjusted position.

2. The apparatus of claim 1, further comprising a plastic bushing positioned in the cylindrical bore of the pin-receiving knuckle for surrounding the lower section of the pin.

3. The apparatus of claim 1, further comprising a plastic cup positioned in the cylindrical bore of the pin-receiving knuckle for surrounding the lower section of the pin.

4. An adjustable butt hinge apparatus for mounting a door in a door frame, comprising first and second mounting plates for attaching respectively to a frame and to a door, first and second generally axially aligned knuckles having inwardly opening cylindrical receivers attached to and extending from edges of the first and second plates, the receivers having first and second cylindrical cavities with closed ends and open ends, the open ends being positioned near each other and in general alignment with each other, and the closed ends of the cavities being positioned remote from each other, an eccentric pin for mounting in the cavities, the eccentric pin having first and second cylindrical portions offset on parallel axes and respectively mounted in the first and second cavities, a lateral tapped opening in the first receiver extending from an outside thereof into the first cavity therein, a lateral set screw extending through the lateral tapped opening for releasing and fixing the first cylindrical section of the eccentric pin in the first cavity for relatively adjusting the first and second mounting plates by moving the plates in and out and side to side after loosening the lateral set screw and releasing the eccentric pin and before tightening the lateral set screw and fixing the first cylindrical section of the eccentric pin in the first cavity, further comprising a vertical tapped opening extending through one of the closed ends into an associated one of the cavities, a vertical set screw in the vertical tapped opening, the vertical set screw having an abutment end extendable into the one cavity for stopping movement of an end of the pin inward in the one cavity.

5. The apparatus of claim 4, further comprising a plastic bushing positioned in the second cavity for surrounding the second cylindrical portion of the pin.

6. The apparatus of claim 4, further comprising a plastic cup positioned in the second cavity for surrounding the second cylindrical portion of the pin.

7. A method of adjusting a door with respect to a door frame, comprising separately connecting a cylindrical pin receiver and a complementary cylindrical pin holder to a door frame and to a door, loosening a lateral set screw in a cylindrical pin holder, twisting an eccentric pin having offset upper and lower cylindrical sections in the cylindrical pin holder and in the cylindrical pin receiver, repositioning a door in and out or side to side with respect to a frame, and tightening the lateral set screw on the pin and thereby adjusting the door in and out and side to side with respect to the door frame, further comprising turning a vertical screw at an end of one of the cylindrical pin holders in a direction inward or outward in the cylindrical pin holder for moving an end of the pin with an end of the vertical screw.

8. The method of claim 7, wherein the twisting of the pin is effected by the adjusting of the door in and out or side to side with respect to the frame.

9. The method of claim 7, further comprising removing the door from the frame by lifting the door.

10. The method of claim 7, further comprising removing the door from the frame by lifting the door, the cylindrical pin holder and the pin from the cylindrical pin receiver.

11. The method of claim 7, further comprising inserting a free section of the pin in a plastic bushing in the cylindrical pin receiver and inserting the lower cylindrical section of the pin in the plastic bushing.

12. The method of claim 7, further comprising inserting a free section of the pin in a plastic cup in the cylindrical pin receiver and inserting the lower cylindrical section of the pin in the plastic cup.

* * * * *